US007426156B1

(12) United States Patent
Bahder

(10) Patent No.: US 7,426,156 B1
(45) Date of Patent: Sep. 16, 2008

(54) METHOD AND APPARATUS FOR CLOCK SYNCHRONIZATION THAT ACCOUNTS FOR CURVATURE IN THE SPACE-TIME CONTINUUM

(75) Inventor: Thomas B. Bahder, Clarksville, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 212 days.

(21) Appl. No.: 10/926,065

(22) Filed: Aug. 26, 2004

Related U.S. Application Data

(60) Provisional application No. 60/499,411, filed on Aug. 26, 2003.

(51) Int. Cl.
*G04C 11/02* (2006.01)

(52) U.S. Cl. ..... 368/46; 368/47; 701/214; 342/357.02

(58) Field of Classification Search ..... 368/47, 368/46, 48, 52–61; 342/357.01, 357.02; 701/207, 213–214
See application file for complete search history.

(56) References Cited

U.S. PATENT DOCUMENTS 5,724,316 A * 3/1998 Brunts ..... 368/10
5,917,322 A 6/1999 Gershenfeld et al. ..... 324/307
6,473,719 B1 10/2002 Steenblik ..... 702/181
2002/0163466 A1* 11/2002 Jin ..... 342/356

OTHER PUBLICATIONS

Bahder, Relativity of GPS measurement; Sep. 29, 2003; Physical Review Letters: vol. D 68, 063005 pp. 1-13.*
Samain : Time Transfer by Laser Lin (T2L2) experiment on Mir; Metrologia, 1998, 35, pp. 151-159.*
Article by I.L. Chung, entitled "Quantum Algorithm for Distributed Clock Synchronization", Phys. Rev. Lett. 85, 2006 (2000), and also in quant-ph/0004105.
Article by R. Jozsa, D. S. Abrams, J. P. Dowling and C. P. Williams, entitled "Quantum Clock Synchronization Based on Shared Prior Entanglement" Phs. Rev. Lett. 85, 2006 (2000).
Article by J. Preskill, entitled "Quantum Clock Synchronization and Quantum Error Correct" quant-ph/0010098.

(Continued)

*Primary Examiner*—Vit W. Miska
*Assistant Examiner*—Sean Kayes
(74) *Attorney, Agent, or Firm*—Edward L. Stolarun; Guy M. Miller

(57) ABSTRACT

Methods and apparatuses for applying a correction that accounts for curvature in the space-time continuum in the context of clock synchronization are disclosed. A representative apparatus, among others, includes a memory having a curved space-time correction module and a processor. The processor is adapted to receive a reference message having a time-stamp from a master-clock and determine a correction to the time-stamp using the curved space-time correction module, wherein the correction accounts for curvature in space-time.

6 Claims, 4 Drawing Sheets

OTHER PUBLICATIONS

Article by V. Giovannetti, S. Lloyd and L. Maccone, Nature 412, 417-419 (2001).
Article by A. Valencia, G Scarcelli, and Y. Shih, Applied Physics Letter vol. 85, No. 13, pp. 2655-2657, Sep. 27, 2004.
Article by E. A. Burt, C. R. Ekstrom, T. B. Swanson, entitled "Comment on 'Quantum Clock Synchronization Based on Shared Prior Entanglement'", Phys. Rev. Lett. 87, 129801 (2001); "A Reply to 'Quantum Clock Synchronization'", quant-ph/0007030.
Article by R. Jozsa, D. S. Abrams, J. P. Dowling, and C. P. Williams, "Jozsa et al. Reply", Phys. Rev. Lett. 87, 129802 (2001).
Article by U. Yurtsever and J. P. Dowling, "A Lorentz-invariance Look at Quantum Clock Synchronization Protocols Based on Distributed Entanglement", quant-ph/0010097.
Article by Thomas B. Bahder and William M. Golden, entitled "Clock Synchronization based on Second-Order Quantum Coherence of Entangled Photons", Army Research Laboratory; Jul. 10, 2004, pp. 1-5.
Article, A. Valencia, M. Chekhova, A. Trifonov, and Y. Shih, entitled "Entangled Two-Photon Wave Packet in a Dispersive Medium", Phys. Rev. Lett. 88 183601 (2004).

* cited by examiner

METHOD AND APPARATUS FOR CLOCK SYNCHRONIZATION THAT ACCOUNTS FOR CURVATURE IN THE SPACE-TIME CONTINUUM

CROSS-REFERENCE TO RELATED APPLICATION

This application claims priority to U.S. provisional application entitled, "Method For Accurate Time Transfer, Clock Synchronization, And Navigation In Curved Space-Time," having Ser. No. 60/499,411, filed 26 Aug. 2003, which is entirely incorporated herein by reference.

GOVERNMENT INTEREST

The invention described herein may be manufactured and used by or for the United States Government for governmental purposes without the payment of any royalties thereon.

TECHNICAL FIELD

The invention generally relates to clock synchronization.

DESCRIPTION OF THE RELATED ART

"Time transfer" is important to many segments of a technologically advanced society. Modern communication systems, such as cryptographic communication systems, computer networks, navigation and positioning systems, and even electric grids, among others, rely upon precise timing and the synchronization of events over a distributed network.

Currently, "time transfer" is generally accomplished by sending reference signals from a master clock, which is highly accurate and highly precise. The reference signals carry a time stamp from the master clock, and recipients of the reference signals can then employ the time stamps to synchronize their local clocks with the master clock. Time transfer systems such as global positioning systems are generally so precise that they account for propagation delays of the reference signals caused by the reference signals being transmitted through the Earth's atmosphere. In addition, time transfer systems account for some special relativistic effects such as time dilation and for some general relativistic effects such as the effect of the Earth's gravitational field on the rate of clocks, such as clocks onboard GPS satellites. However, what is sought is a method and a system that accounts for other general relativistic effects due to propagation of the reference signals through the Earth's gravitational field, and the resulting effects on the measured values of the reference signals, which propagate between the reference signal source, such as a GPS satellite, and the user's receiver.

SUMMARY

An apparatus and a method for applying a correction that accounts for curvature in the space-time continuum in the context of clock synchronization are provided. Briefly described, one embodiment of an apparatus includes a memory having a curved space-time correction module and a processor. The processor is adapted to receive a reference message having a time-stamp from a master-clock and determine a correction to the time-stamp using the curved space-time correction module, wherein the correction accounts for curvature in space-time.

An embodiment of a method can be broadly summarized by the following steps: receiving at a receiver a reference signal from a transmitter, the reference signal carrying a timestamp that is related to the time the reference signal was emitted from the transmitter; and determining the time that the reference signal was received at the receiver using the reference signal, wherein the determination of the time includes applying a correction that accounts for curvature in the space-time continuum, wherein correction for curvature in the space-time continuum is a function of both $r_R$ and $r_T$, where $r_T$ is the position of the transmitter at the time of emission of the reference signal, and where $r_R$ is the position of the receiver at the time of reception of the reference signal.

Other systems, methods, features, and/or advantages will be or may become apparent to one with skill in the art upon examination of the following drawings and detailed description. It is intended that all such additional systems, methods, features, and/or advantages be included within this description and be protected by the accompanying claims.

DETAILED DESCRIPTION

Figure 1:
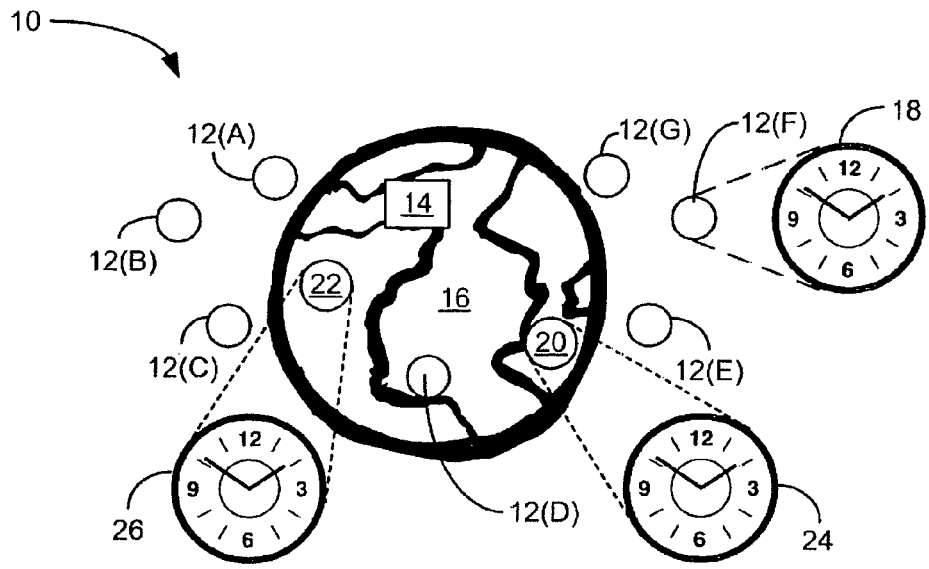
FIG. 1 is a diagram of a synchronized reference signaling system, a mobile receiver, and a stationary receiver.

FIG. 1 illustrates portions of a synchronized reference signaling system 10, which for the purposes of this disclosure will be described in terms of a global positioning system (GPS) 10 such as "Navstar"®. However, this is done for exemplary purposes only. Those skilled in the art will recognize that other embodiments include other systems that provide "time transfer" functionality through the transmission of reference signals.

GPS 10 includes a plurality of satellites 12 of which only 12(A)-12(G) are illustrated and a ground control system 14. Each one of the satellites 12 completes an orbit around the Earth 16 in approximately 12 hours. The ground control system 14 monitors the orbits of the satellites 12 and provides the satellites 12 with trajectory information. Each satellite 12 uses its trajectory information to determine its position and each satellite broadcasts reference signals or navigation messages. Other embodiments include, but are not limited to, a system having geo-synchronous satellites, and a system having terrestrial transmitters.

A navigation message from a given satellite such as satellite 12(F) includes a time stamp and the current position of the satellite 12(F). The time stamp corresponds to the time of transmission ($t_T$) from the satellite 12(F) as measured by an internal clock 18 in the satellite 12(F). Each one of the satellites 12 has its own internal clock 18. The internal clocks 18 are set so that they compensate for time dilation due to their motion and to compensate for being in a state of gravitational potential energy that is higher than the gravitational potential energy of terrestrial objects. Those skilled in the art recognize that the heart of the GPS 10 is synchronization of the internal clocks 18. Consequently, the internal clocks 18 must perform with a high degree of accuracy and precision, which is why the internal clocks 18 are atomic clocks. Furthermore, for the purposes of this disclosure, the internal clocks 18 can be regarded as being "master" clocks to which other clocks are synchronized.

A mobile receiver 20 and a stationery receiver 22 receive navigational messages. The mobile receiver 20 includes a local mobile receiver clock 24. Using navigation messages and its local mobile receiver clock 24, the mobile receiver 20 is adapted to determine its position.

The stationery receiver 22 includes a local receiver clock 26. The stationery receiver 22 knows its position, and knowing its position, the stationery receiver 22 is adapted to use navigation messages and its local receiver clock 26 to determine, among other things, a time correction that accounts for curvature in the space time continuum. Typically, primarily for reasons related to cost and portability, among others, the local mobile receiver clock 24 and the local receiver clock 26 are only approximately synchronized with the internal clocks 18. Clocks that are accurate enough to be synchronized with the internal clocks 18 are generally expensive and large.

In some embodiments, the stationery receiver 22 is part of a communication system that employs precise timing information as part of an encryption scheme. For example, the stationary receiver referred to above may not be stationary, but may be in motion with respect to the Earth-centered inertial frame or with respect to the Earth-centered Earth-fixed frame. This receiver may be part of a high-speed communication system that uses cryptographic communications. In other embodiments, the stationary receiver 22 is part of a telephone network, a communication network, a computer network, an electrical power grid, or other system/apparatus known to those skilled in the art that employs "time transfer."

Those skilled in the art recognize that a reference frame is defined by four coordinates (z0, z1, z2, z3), where z0=cτ where c is the universal constant for the speed of light in a vacuum, and τ is time measured in that coordinate system, and (z1, z2, z3) are three orthonormal spatial coordinates such as Cartesian coordinates. Those skilled in the art know that distances in a reference frame are not properly measured in Euclidean spatial coordinates, but are instead properly measured by accounting for curvature in the space-time continuum.

Figure 2A:
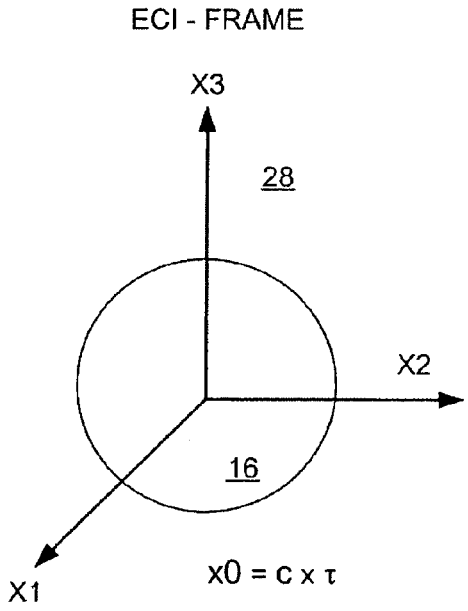
FIG. 2A is a diagram of an Earth-Centered-Inertial reference frame.
Figure 2B:
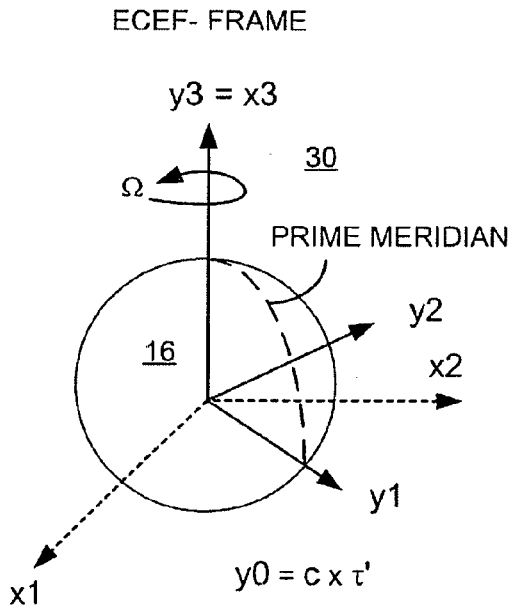
FIG. 2B is a diagram of an Earth-Centered-Earth-Fixed reference frame.

FIGS. 2A and 2B illustrate two reference frames, Earth-Centered-Inertial (ECI) 28 and Earth-Centered-Earth-Fixed (ECEF) 30, respectively. Conceptually, the ECI frame 28 is a fixed inertial reference frame in which the rotation of the Earth is ignored and when viewed from a distant observation point, the ECI frame 28 keeps the same orientation, i.e., it does not rotate. Specifically, the origin of the ECI reference frame is located at the center of the Earth, and the axis x1 points from the center of the Earth towards the Sun. Specifically, x1 vector points towards the Vernal Equinox. The x3 vector is aligned with the Earth's rotational axis.

The ECEF reference frame 30 accounts for the Earth's rotation and is fixed with respect to the Earth, i.e., the ECEF reference frame rotates with the Earth. The vectors y1 and y2 lay in the equatorial plane of the Earth, and the vectors y1 and y3 lay in the prime meridian plane of the Earth. The vector y3 of the ECEF frame is aligned with the rotational axis of the Earth. In addition to spatial/geometric coordinates x1, x2, x3 and y1, y2, y3 of the ECI frame 28 and ECEF frame 30, respectively, events measured in the ECI frame 28 and ECEF frame 30 are properly measured using a four vector which includes x0 and y0, respectively. x0 of the ECI frame is equal to c·τ, where c equals the speed of light in a vacuum, and τ equals a unit of time as measured in the ECI frame. y0 of the ECEF frame 30 is equal to c·τ', where τ' is a unit of time measured in the ECEF frame 30. For the purposes of this disclosure, the coordinates of the ECI frame 28 are denoted by the four vector X={x0, x1, x2, x3}, and the coordinates of the ECEF frame 30 are denoted by the four vector Y={y0, y1, y2, y3}.

The internal satellite clocks 18 are synchronized with respect to the ECI frame. As an approximation, both the ECI and ECEF reference frames 28 and 30 respectively, ignore the Earth's rotation around the sun. The ECI frame 28 and ECEF frame 30 can be related by a time dependent rotation matrix having a periodicity of approximately one Earth rotation, i.e., approximately 24-hours. The relationship between the ECI frame 28 and ECEF frame 30 is given by:

$$X=RY, \tag{1}$$

where:

$$R=\begin{pmatrix} 1 & 0 & 0 & 0 \\ 0 & \cos\left(\frac{\omega}{c}y0\right) & -\sin\left(\frac{\omega}{c}y0\right) & 0 \\ 0 & \sin\left(\frac{\omega}{c}y0\right) & \cos\left(\frac{\omega}{c}y0\right) & 0 \\ 0 & 0 & 0 & 1 \end{pmatrix}. \tag{2}$$

Alternatively, a different matrix can be used to relate these two systems of coordinates.

Stationary Receiver

Figure 3:
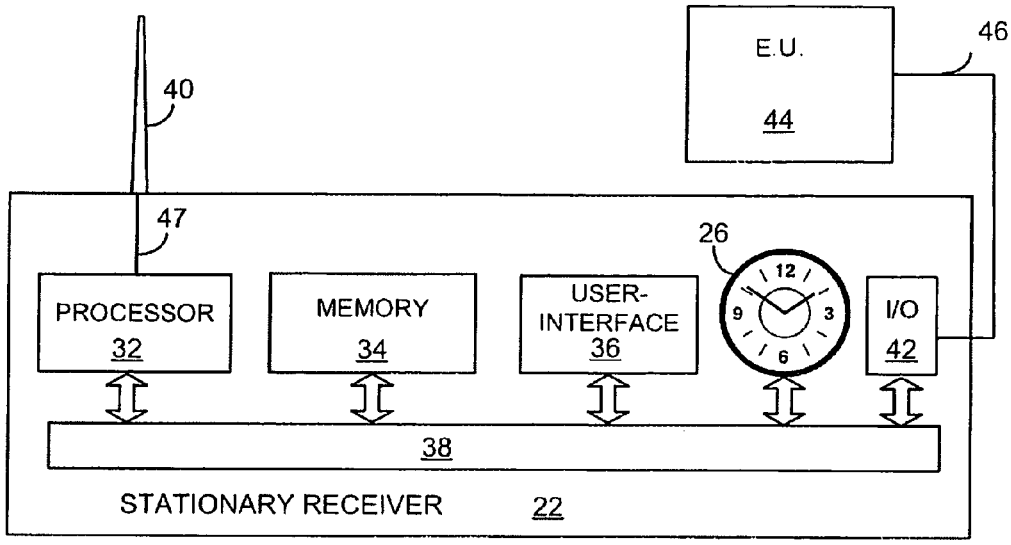
FIG. 3 is a diagram of the stationary receiver of FIG. 1.

Referring to FIG. 3, the stationary receiver 22 includes a processor 32, a memory 34, an input/output (I/O) interface (user interface) 36, a bus 38, and an input/output port 42. The processor 32 is also in communication with an antenna 40 via an electrical connector 47. The processor 32 receiver navigation messages from the GPS 10 via the antenna 40.

Among other things, the processor 32 can implement user commands, which are received via the user interface 36, and modules stored in the memory 34 or other computer-readable medium. The processor 32 can include any custom made or commercially available processor, a central processing unit (CPU) or an auxiliary processor among several processors associated with a computer system, a semiconductor based microprocessor (in the form of a microchip) a macroprocessor, one or more application specific integrated circuits (ASICs), a plurality of suitably configured digital logical gates, and other well-known electrical configures comprising discrete elements both individually and in various combinations to coordinate the overall operation of the stationary receiver 22.

In the context of this document, a "computer-readable medium" can be any appropriate mechanism that can store, communicate, propagate, or transport the program for use by or in connection with the instruction execution system, apparatus, or device. The computer readable medium can be, for example but not limited to, an electronic, magnetic, optical, electromagnetic, infrared, or semiconductor system, apparatus, device, or propagation medium. More specific examples (a nonexhaustive list) of the computer-readable medium would include the following: an electrical connection (electronic) having one or more wires, a portable computer diskette (magnetic), a random access memory (RAM) (electronic), a read-only memory (ROM) (electronic), an erasable programmable read-only memory (EPROM, EEPROM, or Flash memory) (electronic), an optical fiber (optical), and a portable compact disc read-only memory (CDROM) (optical). Note that the computer-readable medium could even be paper or another suitable medium upon which the program is printed, as the program can be electronically captured, via for instance optical scanning of the paper or other medium, then compiled, interpreted or otherwise processed in a suitable manner if necessary, and then stored in a computer memory.

As will be explained in detail hereinbelow, in some embodiments, the processor 32 implements one or more modules included in the memory 34 to determine corrections to its internal local receiver clock 26 using a received navigation message. Thus, the local receiver clock 26 can be synchronized with clocks of the GPS 10.

The time of the local receiver clock 26 is provided to an external device such as an encryption unit 44, via the input/output port 42. A connector 46 extends from the input/output port 42 to the encryption unit 44. The output port may be any number of standard interfaces such as CAT-5, Firewire, or wireless connections.

The user interface 36 typically includes a keypad, or keyboard, or a mouse, or a touch screen/stylus, etc. and/or other devices known to those skilled in the art for enabling a user to input commands/information. In addition, the user interface typically includes a display device for providing a graphical user interface (GUI) known to those skilled in the art and for providing information to the user of the stationary receiver 22.

The encryption unit 44 receives the local time from the stationary receiver 22. The encryption unit 44 then uses the local time in its processing of some data to be encrypted and/or decrypted.

The encryption unit 44 is merely an exemplary device that would use the local time. Other devices include, but are not limited to, devices for navigation and high-speed data transfer (for example between Earth surface and Earth-orbiting satellites). In addition, in some embodiments, the functionality of the stationary receiver 22 can be included in other devices such as, but not limited to, the devices listed hereinabove and vice-versa.

Figure 4:
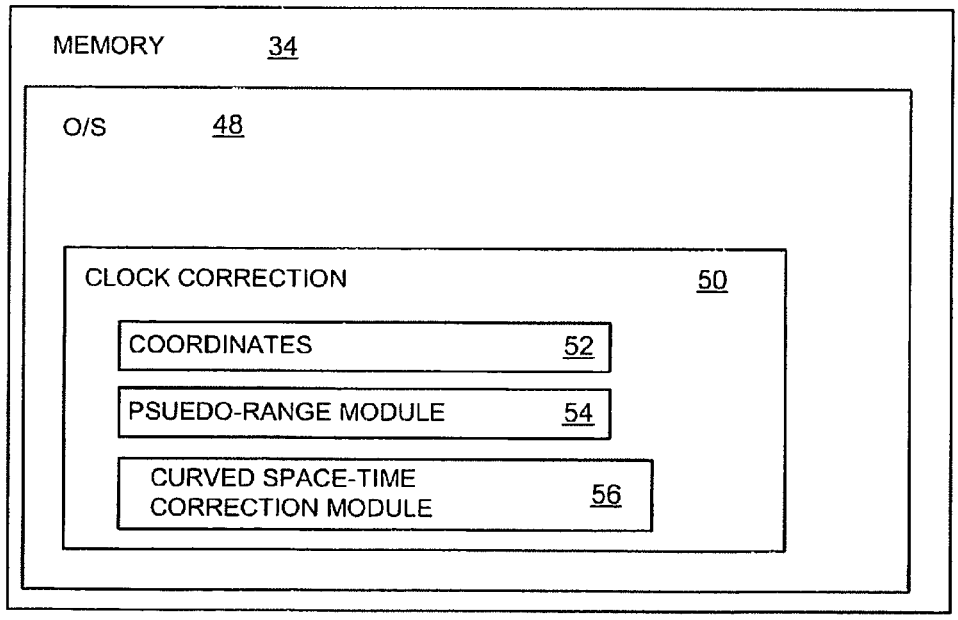
FIG. 4 is a diagram of the memory of the stationary receiver of FIG. 3.

Referring to FIG. 4, memory 34 includes an operating system module 48 and a clock correction module 50. In some embodiments, the memory 34 may include one or more native applications, emulation systems, or emulated applications for any of a variety of operating systems and/or emulated hardware platforms, or emulated operating systems, etc. Memory 34 can, and typically will, comprise other components, which have been omitted for the purposes of brevity. Furthermore, the memory 34 can include any one of a combination of volatile memory elements, e.g., random access memory (RAM such as DRAM, SRAM, etc.), and non-volatile memory elements, e.g., ROM, hard drive, tape, CD-ROM, etc.

The clock correction module 50 includes coordinates 52, which are the coordinates of the antenna 40 in the case that the signals are radio signals, or if the signals are encoded on optical laser links, then the coordinates of the optical detector. Typically, these coordinates can be known within an accuracy of a millimeter and are typically expressed in the body axes of the satellite, and are relatable to the ECEF reference frame 30, i.e., the spatial/geometric position is given by $\{y1_R, y2_R, y3_R)\}$ The clock correction module 50 also includes a pseudo-range module 54, which includes a curved space-time correction module 56. As will be explained in detail hereinbelow, the pseudo-range module 54 includes the logic for determining the range between the stationary receiver 22 and a given satellite 12 using a navigation message from the given satellite.

The curved space-time continuum module 56 includes logic for compensating for local curved space-time effects which are well-known to those skilled in the art as being general relativistic effects.

Conventional Pseudo-Range

The conventional pseudo-range calculation quantifies the range between a transmitter and a receiver according to the time of flight for a message that travels between the transmitter and the receiver at a known speed. Consider the ideal case where a given transmitter and a given receiver are in an inertial reference frame, and that each has a clock, and that the clocks are synchronized, and that the transmitter sends a message, which includes the time of transmission ($t_T$) and which travels at the speed of light. The time at which the message is received at the receiver ($t_R$) is equal to the transmission time ($t_T$) plus the time of flight ($t_F$). The pseudo-range is then given by:

$$\rho = c(t_R - t_T) = |r_R - r_T|, \tag{3}$$

where $r_T$ is the position of the transmitter at the time of transmission ($t_T$), and $r_R$ is the position of the receiver at reception time ($t_R$).

The pseudo-range correction for an actual (non-ideal) receiver and an actual (non-ideal) transmitter is given by:

$$\rho_{con} = |r_R - r_T| + c\Delta\tau_T - c\Delta\tau_R, \tag{4}$$

where $\Delta\tau_T$ is the conventional transmitter clock correction at event T; where $\Delta\tau_R$ is the conventional receiver clock correction at event R; where event T is defined as the transmission event T=($t_T$, $r_T$); and where event R is defined as the reception event R=($t_R$, $r_R$).

A navigation message from a GPS 10 includes timing information that is used in conventional clock corrections $\tau_T$ and $\Delta\tau_R$. In addition, a single navigation message from a satellite is transmitted at different frequencies so that the receiver of the navigation message can compensate for propagation delays due to the Earth's atmosphere. These compensations and other clock corrections are included within the conventional pseudo-range calculations and are not described herein.

Curved Space-Time Continuum Correction

The curved space-time continuum module 56 includes the logic for solving the following equation:

$$\rho = \rho_{con} + \Delta(r_T, r_R) \tag{5}$$

where $\rho_{con}$ is the conventional pseudo-range equation (eq. 4) and $\Delta(r_T, r_R)$ is a small correction due to the presence of the Earth's gravitational field that modifies the space-time geometry near Earth:

$$\Delta(r_T, r_R) = \frac{2GM}{c^2}\left(\Lambda(r_T, r_R) - \frac{|r_R - r_T|}{R_E}\right) - \frac{\Omega^2 R_E^2}{c^2}|r_R - r_T| \tag{6}$$

where G is the universal gravitational consent, M is the mass of the Earth where c is the speed of light in a vacuum, where $\Omega$ is the angular velocity of the Earth, where $R_E$ is the Earth's equatorial radius, and where $\Lambda(r_T, r_R)$ is a purely geometric function of the position of the satellite (transmitter), $r_T$, and the position of the receiver, $r_R$. The geometric function $\Lambda(r_T, r_R)$ is given by the following equation:

$$\Lambda(r_T, r_R) = \ln\left(\frac{\tan\left(\frac{\theta_T}{2}\right)}{\tan\left(\frac{\theta_R}{2}\right)}\right) \tag{7}$$

and $\theta_T$ and $\theta_R$ are defined by $$\cos\theta_a = \frac{r_a \cdot (r_T - r_R)}{|r_a||r_T - r_R|},\ a = T, R. \tag{8}$$

Navigational Message

Figure 5:
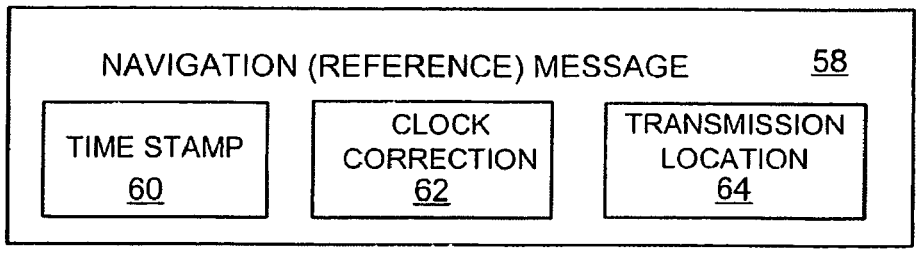
FIG. 5 is a diagram of a reference message.

FIG. 5 illustrates an exemplary navigation message 58 from a given satellite such as satellite 12(F). The navigation message 58 includes a time stamp 60, temporal correction information 62, and transmission location indicator 64. Together, the time stamp 60 and transmission location indicator 64 comprise the transmission event of the navigation message 58. The time stamp 60 includes the transmission time ($t_T$) of the navigation message 58 as measured by the internal satellite clock 18 of the given satellite. The transmission location indicator 64 includes the geometric coordinates of the given satellite at the time of transmission of the navigation message 58. The temporal correction information includes conventional clock correction information that a receiver of the navigation message 58 uses to correct its local clock and to correct the transmission time of the navigation message 58.

Curved Space-Time Correction

Generally, the curved space-time correction as defined by equation 6 is more important to the stationary receiver 22 than the mobile receiver 20 because, generally, the stationary receiver 22 uses the received navigation message 58 to synchronize its local receiver clock 26 with the GPS 10 for purposes other than finding its location. Generally, the curved space-time correction is typically less than 2 centimeters (which, is typically not enough to be of much importance to the mobile receiver 20). It takes light in a vacuum approximately 66 picoseconds to travel 2 centimeters, and many time transfer applications are preformed in the 1 picosecond or femtosecond time scale. Consequently, the curved space-time correction can be used to help synchronize the local receiver clock 26 to the GPS 10 to a high degree of accuracy.

Figure 6:
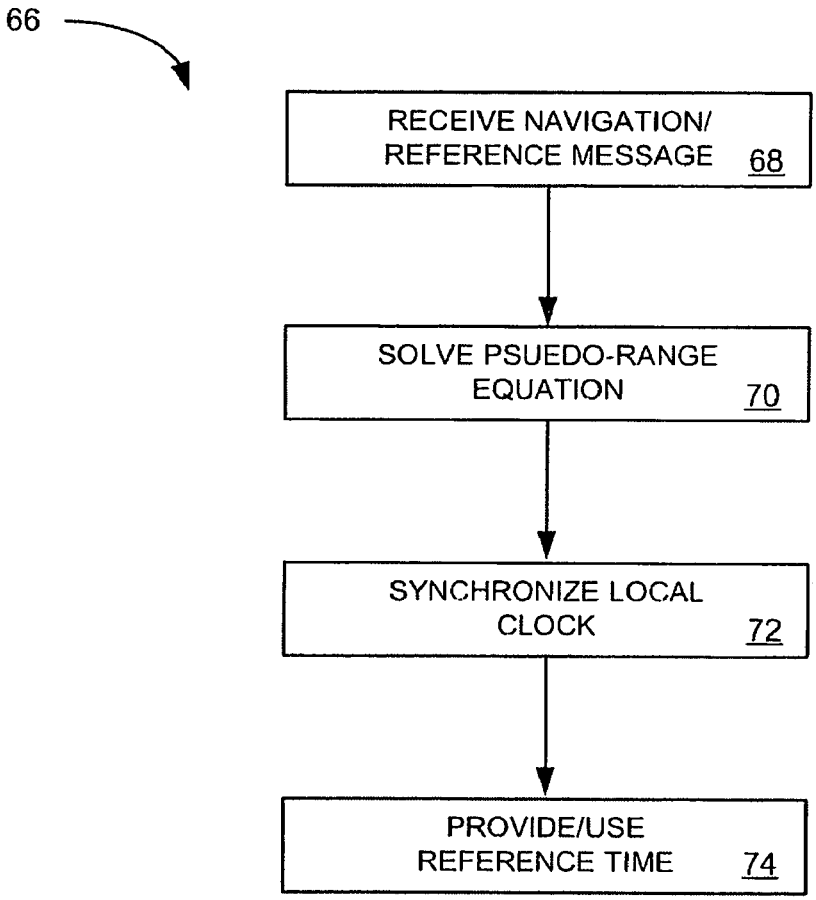
FIG. 6 is an exemplary flow chart of steps implemented by the stationary receiver of FIG. 1.

FIG. 6 illustrates a flow chart of exemplary steps 66 performed by the stationary receiver 22 to compensate for curved space-time effects. It should be noted that any process descriptions or blocks in flow charts should be understood as representing modules, segments, or portions of code which include one or more executable instructions for implementing specific logical functions or steps in the process, and alternate implementations are included within the scope of the preferred embodiment of the present invention in which functions may be executed out of order from that shown or discussed, including substantially concurrently or in reverse order, depending on the functionality involved, as would be understood by those reasonably skilled in the art of the present invention.

In step 68, the stationary receiver 22 receives the navigation message 58. Next, in step 70, the stationary receiver 22 solves the pseudo-range equation (equation 5). It should be noted that here the unknown in the pseudo-range equation is the time of reception because the stationary receiver 22 knows its position and is provided with the transmission event by the navigation message 58, i.e., it is provided with the position and time of the transmission event. Next, in step 72, the stationary receiver 22 synchronizes its local clock 26 with the GPS 10. It should be noted that in some embodiments, the stationary receiver 22 might not include a local receiver clock 26. Instead, the stationary receiver 22 simply uses navigation messages for determining time. Next, in step 74 the stationary receiver 22 uses/provides the time to an appropriate device such as the encryption unit 44.

It should be noted that, in some embodiments, the stationary receiver 22 might not solve all of equation 6 because generally the first term, $$\frac{2GM}{c^2}\left(\Lambda(r_T, r_R) - \frac{|r_R - r_T|}{R_E}\right),$$

is of the order of 1 to 2 centimeters and the second term, $$\frac{\Omega^2 R_E^2}{c^2}|r_R - r_T|,$$

is of the order of 0.0048 centimeters where $$|r_R - r_T| \approx a - R_E,$$

where a is the semi-major axis of the orbits of the GPS satellites 12. Thus, in some embodiments, only the first term, $$\frac{2GM}{c^2}\left(\Lambda(r_T, r_R) - \frac{|r_R - r_T|}{R_E}\right),$$

might be solved because it generally is of larger magnitude.

Figure 7:
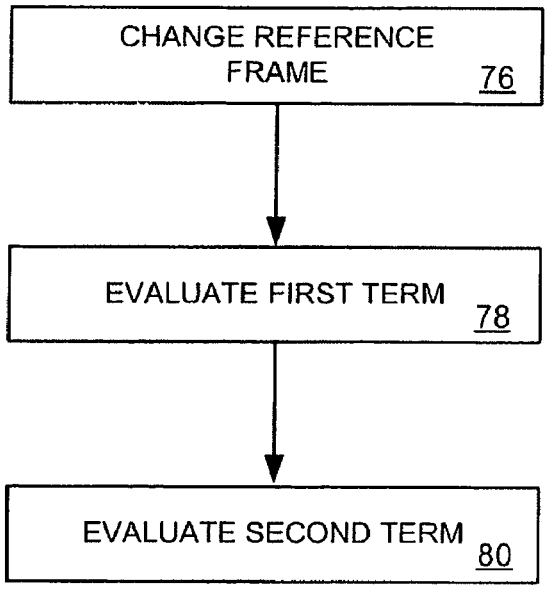
FIG. 7 is an exemplary flow chart of steps implemented by the stationary receiver of FIG. 1.

FIG. 7 illustrates exemplary steps performed by the stationary receiver 22 during step 70. In step 76, the position of the stationary receiver 22 is converted into coordinates defined in the ECI reference frame 28. Normally, the coordinates 52 of the stationary receiver 22 are defined in the ECEF reference frame, and in that case, equation 1 is used in the conversion of the coordinates 52 from one reference frame to the other.

Next, in step 78, the first term, $$\frac{2GM}{c^2}\left(\Lambda(r_T, r_R) - \frac{|r_R - r_T|}{R_E}\right),$$

is evaluated, and then, in step 80, the second term, $$\frac{\Omega^2 R_E^2}{c^2}|r_R - r_T|,$$

is evaluated. As previously described hereinabove, because the second term is smaller than the first term, in some embodiments, step 80 is optional and might not be performed.

Mobile Receiver

The mobile receiver 20 is substantially similar to the stationary receiver 22 except that the mobile receiver 20 does not normally know its location, and hence, the mobile receiver 22 uses navigation messages for determining its current location. Recall, that the pseudo-range equation (eq. 5) includes four unknowns: $\{t_R, r_R\}$, time of reception and position, $r_R=(x1_R, x2_R, x3_R)$ in ECI coordinates. Consequently, the mobile receiver 20 uses navigation messages from four different satellites to determine its current position and current time.

Figure 8:
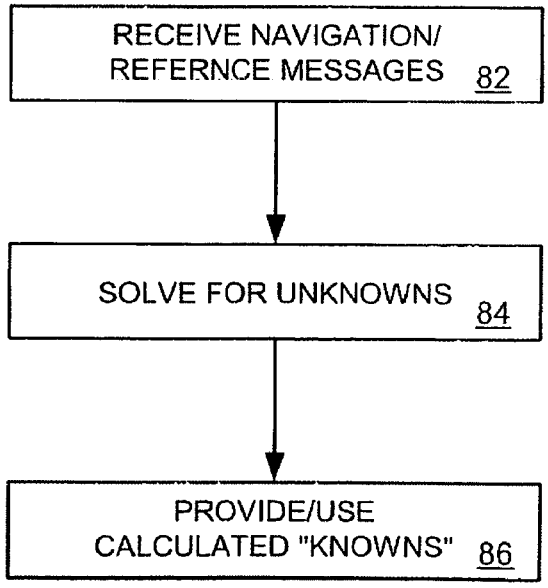
FIG. 8 is an exemplary flow chart of steps implemented by the mobile receiver of FIG. 1.

FIG. 8 illustrates the steps implemented by the mobile receiver 20 in determining its current location. In step 82, the mobile receiver 20 receives multiple navigation messages from multiple satellites. Next, in step 84, the mobile receiver 20 solves pseudo-range equations as given by equation 5 to determine values for the unknowns, i.e., time of reception ($t_R$) and position at reception ($r_R$). The number of pseudo-range equations that are solved correspond to the number of unknowns. Thus, if the local mobile clock 24 is synchronized with the time of the GPS system 10, then only three navigation messages are needed to determine the current position of the mobile receiver 20.

Next, in step 86, the mobile receiver 20 presents and/or uses its calculated "unknowns," i.e., the calculated reference time and position ($r_R$). The calculated position and/or reference time can be presented to a user and/or used by, among other things, a component in a navigation system. Generally, step 86 includes converting the calculated position from one reference frame into another reference frame such as the ECEF reference frame 30.

It should be remembered that embodiments have been described in terms of receiving and using navigation messages from a Global Positioning System, but this has been done only for the sake of clarity. In other embodiments, reference signals might be transmitted from fixed and/or stationary transmitters such as terrestrial transmitters and/or geo-synchronous satellites. Also, the signals may be radio signals or optical signals, or other electromagnetic signals. Consequently, reference signals from fixed and/or stationary transmitters need not necessarily include transmission location information.

In addition, in other embodiments, particularly embodiments having stationary and/or fixed transmitters, certain steps might not be necessary. For example, it might not be necessary to convert positions between coordinate systems.

It should be emphasized that the above-described embodiments are merely possible examples of implementations. Many variations and modifications may be made to the above-described embodiments. All such modifications and variations are intended to be included herein within the scope of this disclosure and the present invention and protected by the following claims

What is claimed is:

1. An apparatus for synchronization with a master-clock, the apparatus comprising:

a memory having a curved space-time correction module stored therein wherein the memory includes the current position ($r_R$) of the apparatus, and the correction is a function of both the apparatus ($r_R$) and a position ($r_T$) that is associated with the master clock; and wherein the correction, $\Delta(r_T, r_R)$, includes the term $$\frac{2GM}{c^2}\left(\Lambda(r_T, r_R) - \frac{|r_R - r_T|}{R_E}\right),$$

where G is the universal gravitational constant, M is the mass of the Earth where c is the speed of light in a vacuum, where $R_E$ is the Earth's equatorial radius, and where $\Lambda(r_T, r_R)$ is a function of the position associated with the master clock, $r_T$, and the position of the apparatus, $r_R$, and which is given by the equation:

$$\Lambda(r_T, r_R) = \ln\left(\frac{\tan\left(\frac{\theta_T}{2}\right)}{\tan\left(\frac{\theta_R}{2}\right)}\right),$$

and $\theta_T$ and $\theta_T$ are defined by $$\cos\theta_n = \frac{r_a \cdot (r_T - r_R)}{|r_a||r_T - r_R|},$$

a=T, R; and a processor in communication with the memory, the processor adapted to receive a reference message having a time-stamp from the master clock, wherein the processor determines a correction to the time-stamp using the curved space-time correction, and wherein the correction accounts for curvature in space time.

2. The apparatus of claim 1, wherein the correction, $\Delta(r_T, r_R)$, further includes the term, $$\frac{\Omega^2 R_E^2}{c^2}|r_R - r_T|,$$

where Ω is the angular velocity of the Earth.

3. An apparatus for synchronization with a master-clock, the apparatus comprising:

means for receiving in a receiver a reference signal from a transmitter, the reference signal carrying a timestamp that is related to the time the reference signal was emitted from the transmitter, wherein the position of the transmitter at the time of emission of the reference signal is given by $r_T$, and wherein the position of the receiver at the time of reception of the reference signal is given by $r_R$; and means for determining the time that the reference signal was received at the receiver using the reference signal, wherein the determination of the time includes applying a correction that accounts for curvature in the space-time continuum, wherein correction for curvature in the space-time continuum is a function of both $r_R$ and $r_T$ and wherein the correction includes a term which is $$\frac{2GM}{c^2}\left(\Lambda(r_T, r_R) - \frac{|r_R - r_T|}{R_E}\right),$$

where G is the universal gravitational constant, M is the mass of the Earth where c is the speed of light in a vacuum, where $R_E$ is the Earth's equatorial radius, and where $\Lambda(r_T, r_R)$ is given by the equation:

$$\Lambda(r_T, r_R) = \ln\left(\frac{\tan\left(\frac{\theta_T}{2}\right)}{\tan\left(\frac{\theta_R}{2}\right)}\right),$$

and $\theta_T$ and $\theta_T$ are defined by $$\cos\theta_n = \frac{r_a \cdot (r_T - r_R)}{|r_a||r_T - r_R|},$$

a=T, R.

4. The apparatus of claim 3, wherein the correction includes a second term which is $$\frac{\Omega^2 R^2}{c^2}|r_R - r_T|,$$

where Ω is the angular velocity of the Earth.

5. The apparatus of claim 3, further including:

reference frame converting means for converting the position of the receiver at the time of reception ($r_R$) from a first reference frame to a second reference frame.

6. The apparatus of claim 3, wherein the first reference frame is Earth-Centered, Earth-Fixed (ECEF) reference frame, and the second reference frame is Earth-Centered-Inertial reference frame.

* * * * *